US005197260A

United States Patent [19]

Chevalier et al.

[11] Patent Number: 5,197,260

[45] Date of Patent: Mar. 30, 1993

[54] METHOD FOR PACKING ARTICLES, AND MACHINE FOR PERFORMING THE METHOD

[75] Inventors: Pierre Chevalier, Boulogne sur Seine; Gilbert E. Veniard, Paris, both of France

[73] Assignee: LEmballage Carton Sa (Societe Anonyme), Bretigny Sur Orge, France

[21] Appl. No.: 688,703

[22] Filed: Apr. 22, 1991

Related U.S. Application Data

[63] Continuation of Ser. No. 429,459, Oct. 31, 1989, abandoned.

[30] Foreign Application Priority Data

Oct. 31, 1988 [FR] France ..... 88 14214

[51] Int. Cl.[5] ..... B65B 11/18

[52] U.S. Cl. ..... 53/461; 53/462; 53/460; 53/465; 53/209

[58] Field of Search ..... 53/461, 462, 207, 209, 53/465, 206, 460, 208; 206/472, 481; 229/1.5 R

[56] References Cited

U.S. PATENT DOCUMENTS

| | | | |
|---|---|---|---|
| 1,125,535 | 1/1915 | Hoffman | 53/462 X |
| 1,485,004 | 2/1924 | Wright | 53/207 |
| 1,515,639 | 11/1924 | Webb | 229/1.5 R |
| 1,834,997 | 12/1931 | Beatty | 53/206 |
| 2,018,432 | 10/1935 | Ackley | 53/590 |
| 3,022,615 | 2/1962 | Shroeder et al. . | |
| 3,213,591 | 10/1965 | Feurstein et al. | 53/379 |
| 3,530,643 | 9/1970 | Levi | 53/209 X |
| 3,594,976 | 7/1971 | Jackson | 53/460 |
| 3,626,660 | 12/1971 | Dorfman | 53/209 X |
| 3,673,763 | 7/1972 | Dorfman | 53/209 |
| 3,877,202 | 4/1975 | Hunt | 53/209 X |
| 3,953,956 | 5/1976 | Massman | 53/208 X |
| 4,343,129 | 8/1982 | Gunther | 53/206 |
| 4,589,552 | 5/1986 | Chevalier | 206/492 |
| 4,694,632 | 9/1987 | Gunther | 53/206 X |

FOREIGN PATENT DOCUMENTS

| | | | |
|---|---|---|---|
| 149351 | 7/1985 | European Pat. Off. . | |
| 0273240 | 7/1988 | European Pat. Off. . | |
| 514882 | 12/1930 | Fed. Rep. of Germany . | |
| 833478 | 3/1952 | Fed. Rep. of Germany | 53/462 |
| 1114433 | 9/1961 | Fed. Rep. of Germany . | |
| 1421782 | 1/1976 | United Kingdom . | |

OTHER PUBLICATIONS

"Levimatic Packaging Systems-Series 1000", Sales Brochure of Levimatic Packaging Systems, Inc., San Bernadino, CA.

"Automatic Book Packaging"; Haus L. Levi, Jan. 1982 Issue; Book & Magazine Production.

*Primary Examiner*—John Sipos

*Attorney, Agent, or Firm*—Banner, Birch, McKie and Beckett

[57] ABSTRACT

The invention relates to a machine for packing articles of different sizes which is accordingly intended to use containers that vary in their dimensions and particularly in height.

It is characterized in that it includes a working plane 20 and a reference plane 22 that are substantially perpendicular to one another, and an ascending ramp 24-105-106 extending from one to the other, movable devices 23, 23a kinematically connected to a motor 45, guides located on the path that the closure panels 6 must follow in the course of the displacement of container-article sets 1, at least one pressure element 27–54 having a smooth active base 29, mounted to be movable perpendicular to the working plane 20 and elastically urged toward it, at least one pressure element 30–60 having a smooth active face 34, mounted to be movable perpendicular to the reference plane 22 and elastically urged toward it, and means 70 to 72 intended for the fixation of panels 6 of containers 1 equipped with their contents A.

35 Claims, 9 Drawing Sheets

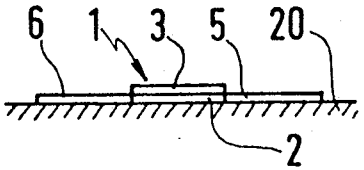
FIG.18
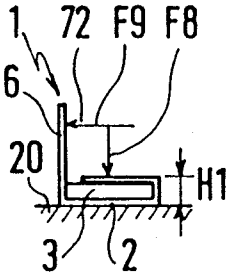
FIG.19
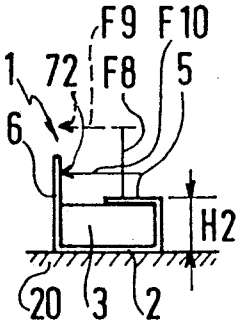
FIG.20
FIG.21
FIG.22
FIG.23
FIG.24
FIG.25
FIG.26

FIG. 27
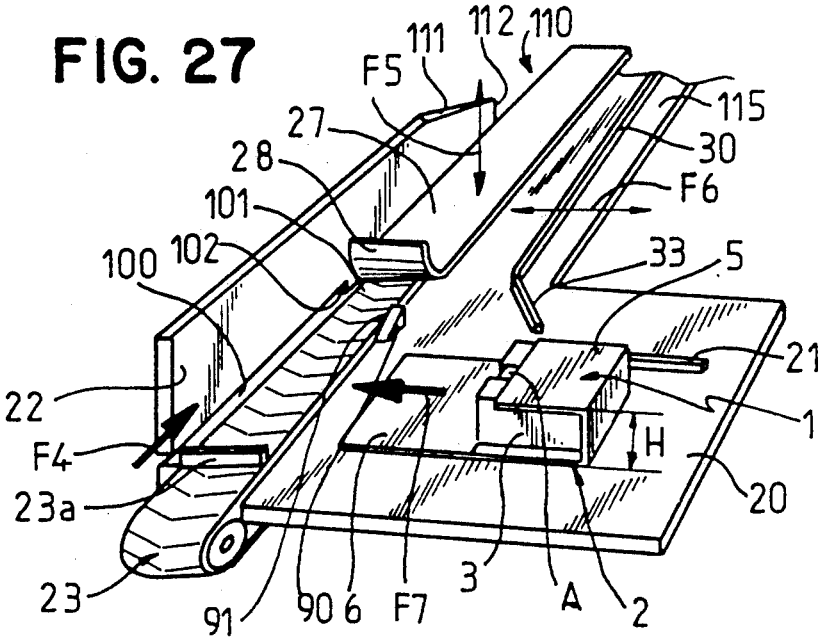
FIG. 36
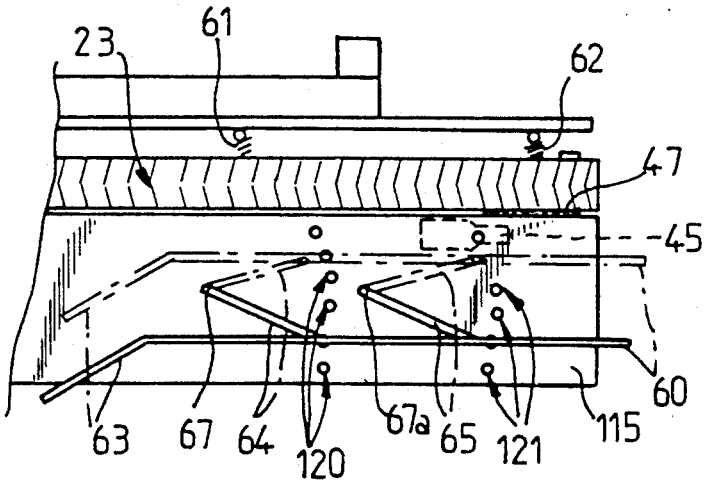
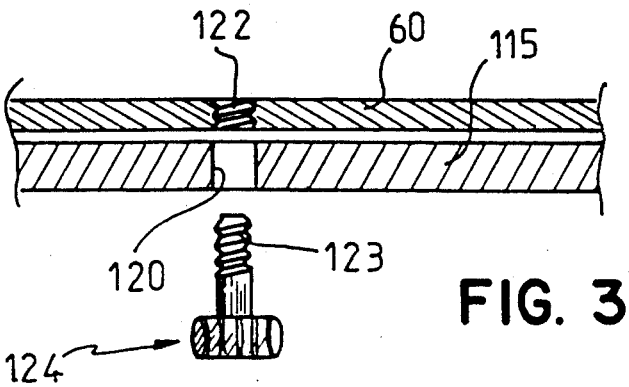
FIG. 37

METHOD FOR PACKING ARTICLES, AND MACHINE FOR PERFORMING THE METHOD

This is a continuation of Application No. 07/429,459, filed on Oct. 31, 1989, which was abandoned upon the filing hereof.

The present invention relates to a method and a machine making it possible to pack articles of various dimensions in containers, the dimensions of which are adaptable to those of the articles.

In general, packaging machines work only with identical containers for packing identical products, and the containers are adapted to the products. Naturally adjustments can be made, making it possible for a given machine to handle various sizes of containers and/or article, but that is always on the assumption of repetitive series of a more or less high number of container-article pairs. Depending on the complexity of the adjustments to be performed, the adaptation takes relatively long, and the expenses are relatively high, so their utility depends essentially on the quantitative magnitude of the series to be handled.

When frequent changes must be made, mechanization and certainly automation are forgone, and one is forced to work manually.

This is true, for example, in assembling parcels meant to contain a more or less large number of books, magazines or disks, depending on the addressee.

Delivery services receive individual orders and make up the parcels on demand. These services are thus presented with the problem of how best to handle a problem with numerous variables: One parcel might contain a large dictionary, another a single compact disk, yet another two books and three magazines, and so forth.

One problem of this type is encountered for example by mail order houses, book, magazine or disk and cassette publishers, press distribution services, express delivery services, and so on. It will be understood that this problem is entirely different from that involved in packaging a large number of identical books, such as 100,000 copies of a dictionary, for example, because in that case the problem is quite simple: all the books are identical, and the corresponding containers are likewise identical.

To solve the difficult problem of the great disparity in dimensions other than by using common envelopes, which are nearly always too large, containers are known that are adaptable within certain limits to articles of variable thickness.

One such container includes a base on which the article to be packed is placed, lateral tabs for holding the article, a longitudinal flap, and finally a closure panel which is also longitudinal but is opposed to the flap with respect to the base.

This container is sometimes called an "envelope type", because it makes it possible to envelop the article regardless of its thickness, and the lines along which the flap and the closure panel fold forms almost naturally at the intended height. The fixation of the closure panel is advantageously done by gluing it to the flap. Depending on the thickness of the packed article the gluing is done more or less close to one edge of the container. When the container is closed with a strap, the strap encircles the container and as, is well known, its length adapts automatically to the length of the circumference. Here, the variable element is no longer the gluing, but rather the free edge of the closure panel, which is located more or less close to the edges of the container.

The adaptability of this container to various thicknesses of an article is completely efficient, because the container is perfect, even if it contains only a single sheet (as is the case with fragile documents and/or those that must not be folded, such as drawings on tracing paper, photographs and other graphic elements, for example intended for photoengraving). On the other hand, it is quite clear that this adaptability has limits in terms of thickness, and when an article is truly quite thick, either the container size must be changed, or a container of some other type must be used, such as a box, shipping container, paper and twine, cardboard and banding, and so forth.

When the packing is done manually with a container of the type described above, the worker will immediately know what size of container he must use, depending on the article to be packed. Specifically, the worker receives preassembled batches that he picks up one by one from a supply set on a table or placed in baskets, and he visually estimates the size - length, width and thickness - in order to select a container of the most suitable size from a supply of containers classified by size.

This part of the work of packing cannot be mechanized or automated, except with a machine of a complexity and price that are disproportionate to the service performed. Because of this, no machine capable of performing an operation of packing articles of different thicknesses in containers of adaptable height exists.

The present invention solves this problem and makes it possible to mechanize and automate the packing process after the selection of the container, but regardless of the type of container selected, within a certain range.

To this end, the subject of the invention is a method for packing articles in containers made from plates formed of pliable material including a base integrally joined with at least one flap and at least one closure panel, characterized in that the plates are placed one by one on their outer face on a plane known as the "working surface", with their opposite face comprising the inner face of the plate after closure; that for each plate at least one article to be packed is placed on the base of the corresponding plate; that at least one flap is placed on this article; that the set comprising the plate and the article are displaced along a path parallel to the said working surface; that the closure panel is folded up out of the plane of the working surface; that said closure panel is held in a plane known as the "reference plane" substantially perpendicular to the working surface; that the closure panel is folded down onto the flap by folding it at the height of the outer face of said flap; and that said closure panel is affixed to said flap.

The subject of the invention is also a machine for performing the above method characterized in that it includes a working plane and a reference plane that are substantially perpendicular to one another, as well as an ascending ramp extending from one to the other, movable devices connected kinematically to a motor, guides located along the path that the closure panels must take in the course of displacement of the container-article sets, at least one pressure element having an active smooth face mounted movably perpendicular to the reference plane and urged elastically toward it, and means intended for the fixation of panels of containers equipped with their contents.

The invention will be better understood from the ensuing detailed description made with reference to the accompanying drawing. It is understood that the description and drawing are given only by way of illustrative and non-limiting example.

FIGS. 18-20 are schematic views that show the adjustment of the position of the gluing of the closure panel of a container plate of the type shown in FIGS. 1 and 2, depending on the thickness of the contents.

FIGS. 21-26 are schematic views illustrating the automatic control of a glue distributor for fixation of the closure panel of a container plate of the type shown in FIGS. 1 and 2, depending on the thickness of the contents.

FIG. 27 is a fragmentary schematic view, in perspective, showing a variant embodiment of a machine according to the invention, which provides a particular manner of folding up the closure panels of the container plate.

FIG. 36 is a fragmentary schematic plan view showing a variant, in which the machine includes means for blocking lateral pressure elements.

FIG. 37 is a fragmentary schematic sectional view of the machine made in accordance with the variant of FIG. 36.

Figure 1:
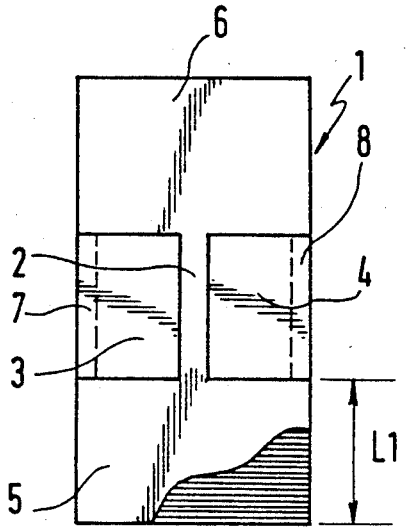
FIGS. 1 and 2 are schematic views of a container plate of a known type that can be used to implement the invention, and with which the invention will be illustrated by the description and the drawing.

Turning to FIGS. 1-5, it can be seen that in order to illustrate the invention a container plate 1 of a known type has been selected, including essentially a bottom plate and two attached side tabs. These elements define a base 2 extending beneath the side tabs 3 and 4, with one end portion comprising a flap 5 and opposite it another end portion comprising a panel or "closure panel" 6.

The side tabs 3 and 4 are affixed by adhesive bonding, or the like, along the longitudinal edges of the base 2 over a width l that defines "sidewalks" 7 and 8, for the sake of effective protection of the contents A, as is well known per se.

It should be noted that in the blanks, the base 2 may be located in the center of the plate, as is the case here, or toward one end as shown and described in U.S. Pat. No. 4,589,552, issued May 20, 1986 to Pierre Chevalier. In that case the base 2 would be positioned at one of the ends of the plate instead of the flap 5 or instead of the panel 6; that is, the tabs 3 and 4 would be attached to the plate adjacent one of its ends. As will be seen below, this structure would make for little change in the manipulations done, compared with those that will be described for the container plates of FIGS. 1-5.

It would also be possible to use a container plate having a different structure, as long as it has a base and at least one flap intended to receive a closure panel. It would be possible, for example, that such a container plate might not have side tabs 3 and 4. Then it would have only the base 2, the flap 5 and the closure panel 6, which would lend it the structure known in the industry as a "sheath".

The shading in FIG. 1 shows that here the container plate 1 is made of corrugated cardboard, the grooves of which are visible. This facilitates the transverse folding of the container plate 1, and no scored folding line need be provided.

Figure 2:
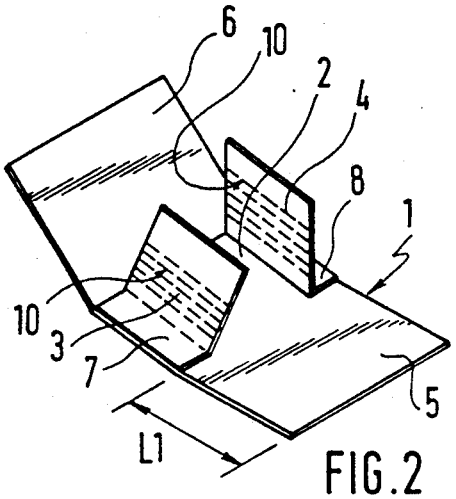

FIG. 2 shows how the container plate 1 looks at the time of use. The side tabs 3 and 4 are folded upright, and for easier comprehension, the flap 5 and the panel 6 have been shown slightly raised.

Figure 3:
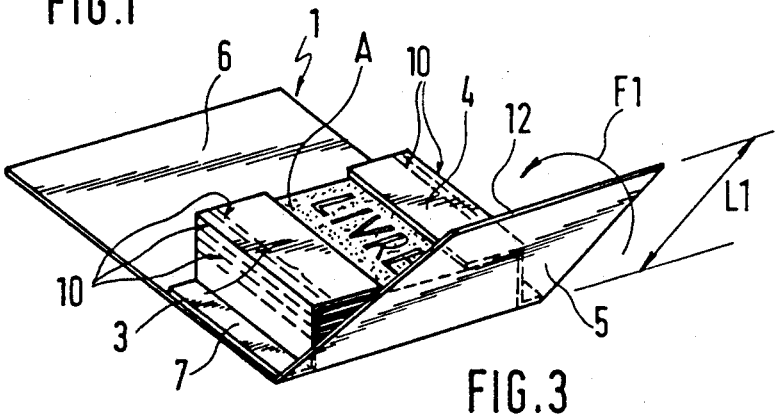
FIGS. 3, 4 and 5 are schematic views that show the packing of a book using a container plate of the kind shown in FIGS. 1 and 2.
Figure 4:
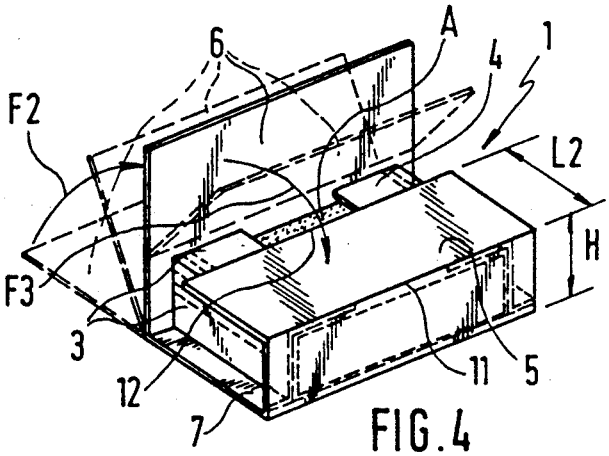
Figure 5:
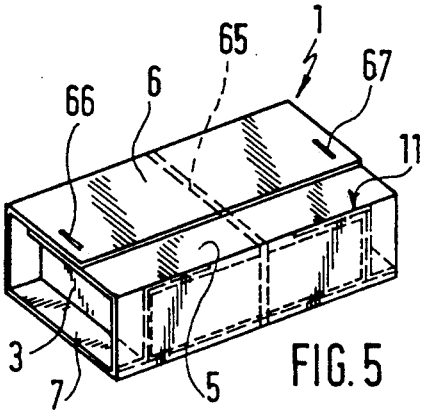

Turning now to FIGS. 3 to 5, it can be seen how, in the prior art, manual packing of an article A is done, using a container plate of the type shown in FIGS. 1 and 2.

Folding up the tabs 3 and 4 exposes the base 2, and the article A to be packed is placed on it. Here, the example of a single book has been shown. In the present description, and in the ensuing claims, the word "article" in the singular means either a single article or a plurality of articles stacked on one another and/or placed side by side. This is often the case in practice for mail order houses or delivery services: several magazines; one magazine, one catalog and one disk; and so forth.

After the article A has been placed on the base 2, the side tabs 3 and 4 are folded over the article A along a transverse line, the location of which depends on the thickness of the article A. To facilitate this operation, a variably large number of staggered folding lines 10 depending on the precision desired can be pre-scored in the material making up the tabs 3 and 4, either on only one face or on both faces of these flaps 3 and 4. These lines 10 are particularly useful when the container plate 1 is made of corrugated cardboard, the grooves of which are perpendicular to the direction in which the tabs 3 and 4 are folded.

In this position (FIG. 3), only the short sides and the lower face of the article A are protected. To completely protect the article A, not only must the tabs 3 and 4 be held in this position, but the packing must also be completed along the long sides and on top of the article A.

To do so, as shown in FIG. 3, the flap 5 is folded upright and necessarily folds against the end of the sidewalks 7 and 8, or, in other words, at the level of the base of the article A (in the case of a single book, its underside). Continuing the movement indicated by the arrow F1, the flap 5 is made to fold necessarily against the edges of the side tabs 3 and 4, or, in other words, at the level of the upper face of these tabs 3 and 4 and pressed against the article A.

Turning to FIG. 4, it can be seen that the fold 11 is thus formed naturally at the correct level, and this is done all the more easily since the grooves of the corrugated cardboard extend transversely to the container plate 1, and the fold is thus located more or less close to the free end 12 of the flap 5, depending on the thickness of the article A. For a given length L1 of the flap 5, a height H that is all the greater, the thicker the article A, is thus available, and a length L2 that is all the shorter, and vice versa. In all cases, the length L2 determining the extent of coverage of the side tabs 3 and 4 must be sufficient to assure their correct retention. After trial and error, if it is seen that the length of the tabs 3 and 4 folded onto the article A and/or the length L2 is inadequate, then a container plate of larger dimensions must be used.

To complete the packing, the closure panel 6 is folded up along the arrow F2, and then folded down onto the flap 5 along the arrow F3. This produces the "finished product" shown in FIG. 5.

However, for this packet or parcel to be usable, it is necessary for the closure panel 6 to be held in place, because this alone assures the cohesion of the assembly.

In practice, several means are available, three of which are generally used: gluing the lower face of the panel 6 to the outer face of the flap 5; fixing the panel 6 to the flap 5 by staples; and encircling the package with at least one strap, such as a plastic tape or a metal band.

The method according to the invention makes it possible to mechanize a major portion of the packing process that has just been described.

For reasons of economy and simplicity, the following manual operations are retained:

selection of the size of the container as a function of the article to be wrapped;
folding up of the tabs 3 and 4 (if present);
placing the article A to be packed on the base 2;
folding the tabs 3 and 4 (if present) onto the article
folding the flap 5 up and then folding it down; and
optionally, folding up the closure panel 6.

All the other operations are accomplished by machine, as will be described below with an exemplary machine, regardless of the dimensions involved, that is, the length and width of the container plate and thickness of the article to be packed.

Figure 6:
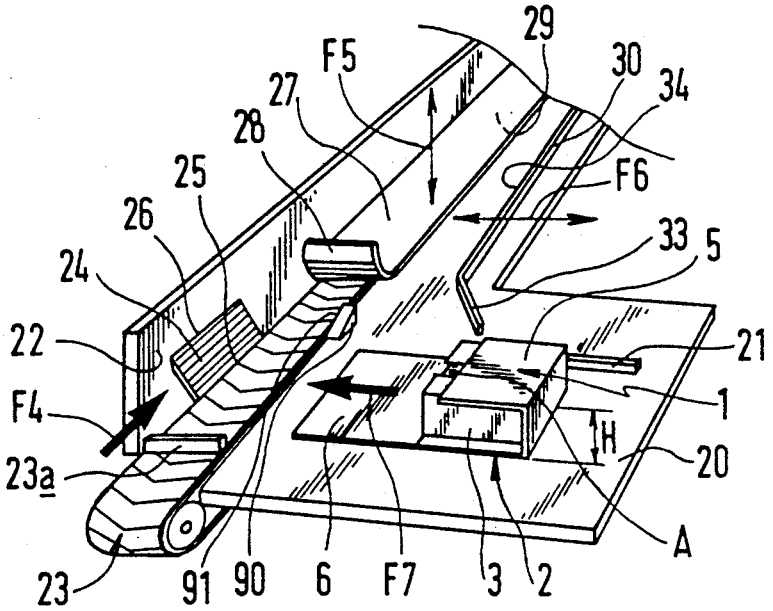
FIG. 6 is a schematic fragmentary perspective view showing important elements in a machine according to the invention.

In FIG. 6, a container plate 1 is seen in the situation described above, that is, equipped with an article A and having its side tabs 3 and 4 folded onto the article A and having its flap 5 folded down onto the tabs 3 and 4 and its closure panel in its original position, in the extension of the base 2.

This has been done by hand by a worker located in front of a working surface 20 (in this case comprising a horizontal table, also identified by reference numeral 20), in proximity with which a supply of plates 1 of several sizes and a supply of articles to be packed - single articles or grouped batches of any known manner, optionally with a label prepared with the address of the addressee - have been placed.

The set of a container plate and article A shown in FIG. 6 is positioned against a rectlinear guide 21 that is integrally joined to the working surface 20 and is thus located facing a reference plane 22, comprising a smooth face of a profile section placed on edge horizontally (and also identified by reference numeral 22). The working surface 20 and the reference plane 22 are thus perpendicular to one another.

The horizontal table 20 does not extend as far as the profile section 22, because an endless chain 23 has been provided, the upper side of which is horizontal, located at the same level as the table 20 and movable parallel to the profile section 22, as indicated by the arrow F4.

The selection of a chain to make the strap with a closed path appears to have many advantages, above all, if a commercially available chain is used that enables orientation of the links with one another in three dimensions, because then it is possible to provide the chain with a path either with or without a change in level, which lends a great deal of flexibility in designing a machine according to the invention. However, the invention can also be performed by a machine having a closed-path strap of some other type, such as a cable, belt or other conveyor systems.

An ascending ramp 24 is inclined from bottom to top along the profile section 22. Its lower edge 25 is no higher than the same level as the table 20, although it can be lower without any disadvantage, and its upper edge 26 is in the reference plane 22. It can be seen in FIG. 6 that the lower edge 25 is located beyond the side of the chain 23 closest to the profile section 22, but in FIG. 7, a variant has intentionally been shown in which the lower edge 25 is above the upper side of the chain 23. The ramp 24 may also be a bridge over the chain 23 to connect it to the table 20, but as will be better understood below, the ramp 24 must project as little as possible from the reference plane 22, even if it is movable in such a way that the version of FIG. 6 would appear better than that of FIG. 7.

Furthermore, the ramp 24 may be curved, concave, as shown, or even be planar, along an inclined plane.

Above the chain 23 is a vertical pressure element 27 mounted such that it is movable perpendicular to the working plane 20, as represented by the double arrow F5. This element 27 is urged constantly toward the working plane 20 by its own weight and can easily be raised.

Its upstream end, in terms of the direction of displacement of the chain 20 in accordance with the arrow F4, is raised along a curve and forms a kind of raised tip 28 similar to the tip of a ski. The lower face 29 of the pressure element 27 comprises its usable face, and this face must be smooth or even slippery, planar and parallel to the working plane 20.

Extending above the table 20 is a horizontal pressure element 30 mounted to be movable perpendicular to the reference plane 22, as indicated by the double arrow F6. This element 30 is urged constantly toward the reference plane 22 by springs 31 and 32 (see FIG. 17, in which, for the sake of simplicity in the drawing, the spring 31 has been shown merely as a single dotted line).

The upstream end of the pressure element is angularly displaced, to form a rectilinear segment 33 that diverges from the reference plane 22. As will be seen below, this segment 33 may also be curved like the tip 28 of the element 27, and this tip 28 may be rectilinear like the segment 33. This is why the two variants have intentionally been shown. The important factor is that an oblique guide be available that progressively matches the plane of the usable face of the element.

The side face 34 of the pressure element 30 located facing the reference plane 22 comprises the usable face of this element, and must be smooth or even slippery, planar, and parallel to the reference plane 22.

The pressure element 27 is connected to fixed portions of the frame of the machine by connecting rods 35 and 36 articulated on the element 27 by pivots 37 and 37*a* and on the frame by pivots 38 and 38*a*. With the element 27, these connecting rods 35 and 36 comprise an articulated parallelogram, by means of which the element 27 can be raised and lowered while keeping its sides parallel.

The pressure element 30 is connected to fixed portions of the frame of the machine by connecting rods 39 and 40 articulated on the element 30 by pivots 41 and 41*a* and on the frame by pivots 42 and 42*a*. With the element 30, these connecting rods 39 and 40 comprise an articulated parallelogram, by means of which the element 30 can be spaced apart from and approach the reference plane 22 while keeping its sides parallel.

The method according to the invention proceeds, by means of the machine described above, as follows:

The operator selects a container plate 1 in a given size, depending on his estimation of the article A to be packed. He places it on the table 20 and folds up the side tabs 3 and 4. He places the article A on the base 2 and then creases and folds down the tabs 3 and 4, then folds up the flap 5, creases it and folds it down onto the tabs 3 and 4.

He places this set comprising the container plate 1 and article A (hereinafter also simply identified as the "set 1") against the rectilinear guide 21 and pushes it in the direction of the arrow F7. The leading end of the closure panel 6 meets the ramp 24, which forces it upright while the operator continues to push in the direction of the arrow F7, until the base 2 meets the reference plane 22, because then the closure panel 6 is folded vertically up and placed against the profile section 22.

On this subject, it should be specified that if the ramp 24 is fixed, then it necessarily projects with respect to the reference plane 22. This may be acceptable if the projection is slight and if the ramp 24 extends over a short length, because then the container is placed along a slightly oblique line which does not impede the course of operations. This clearly assumes that the container plates 1 fold easily and that they are comparatively long with respect to the ramp 24.

If the ramp 24 must be relatively wide, as, for example, if it must have a very major projection to bring about the correct folding of the container plates, then it is advantageous to make the ramp 24 movable, so that it can move out of the way of the reference plane 22.

One skilled in the art can avail himself of multiple means for creating such a mounting, so it will not be described in detail here. For example, the ramp 24 may be mounted on a hinge parallel to its upper edge 26, and associated with a return spring in the active position. This spring must be calibrated, so as to withstand the thrust along the arrow F7 as long as the folding up of the panel 6 lasts, on the one hand, this folding up requiring only slight effort, and, on the other hand, to yield when the thrust is exerted directly by the base 2 of the container 1, this thrust being clearly greater than that required merely to fold the panel 6 upright.

Figure 8:
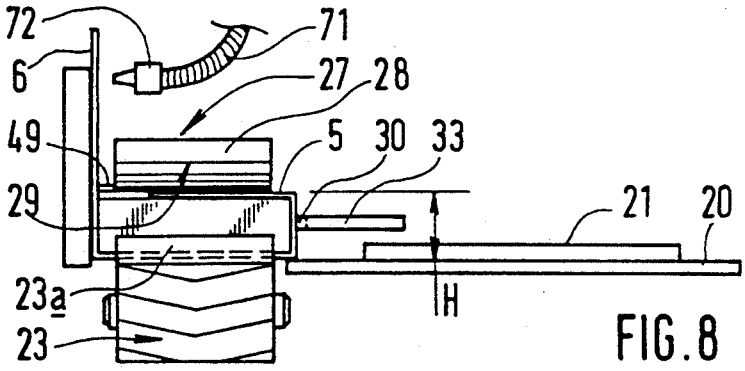

When container plate 1 has been in the position shown in FIG. 8, the rear end of the base 2 rests on the working surface 20, and the outer face of the closure panel 6 is pressed against the reference plane 22.

Figure 7:
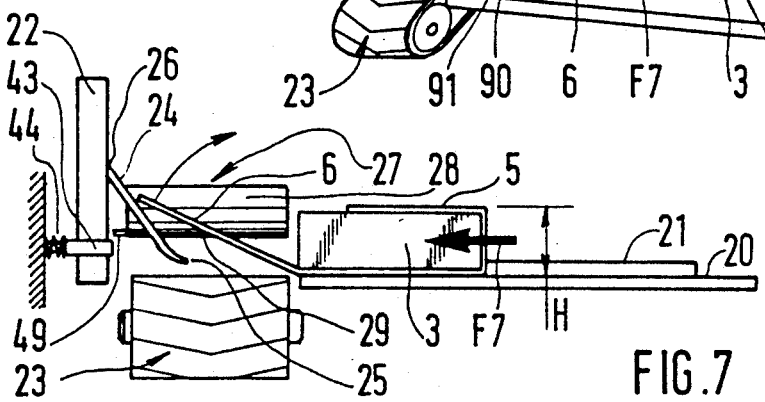
FIGS. 7-10 are schematic elevation views of important phases in the packing method according to the invention, applied to a container plate of the type of FIGS. 1 and 2.

The vertical pressure element 27 is in its lowermost position, and it is placed here in the most probable situation, considering that the container-article set 1 is higher than the lower usable face 29 of this element (FIG. 7).

At this moment, the container-article set 1 must be displaced parallel to the reference plane 22, counter to it, always resting on the working surface 20. This displacement is assured by the chain 23, which from place to place has projecting tappets 23*a*, as is well known per se.

Startup of the chain 23 may be done in various ways: by action of the operator on a contact pedal, closure of a contact by the ramp arriving in the withdrawal position, and so forth. Here, the solution selected comprises providing a contact 43 next to the ramp 24, urged by a spring 44 closing the circuit of an electric back-geared motor 45, the output gear 46 of which meshes with a gear 47 driving the chain 23 via a transmission chain 48 (see FIGS. 16 and 17).

Figure 11:
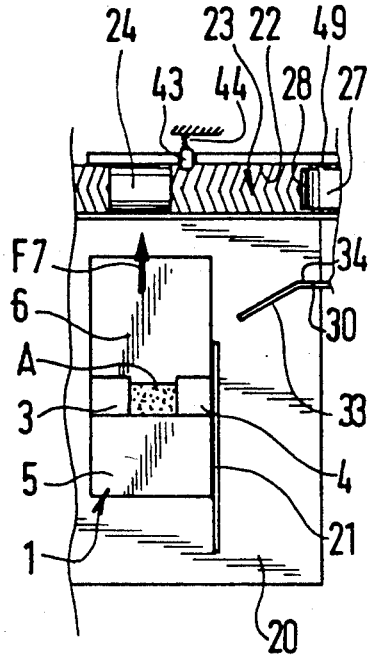
FIGS. 11-15 are schematic plan views of important phases in the packing method according to the invention, applied to a container plate of the type of FIGS. 1 and 2.
Figure 12:
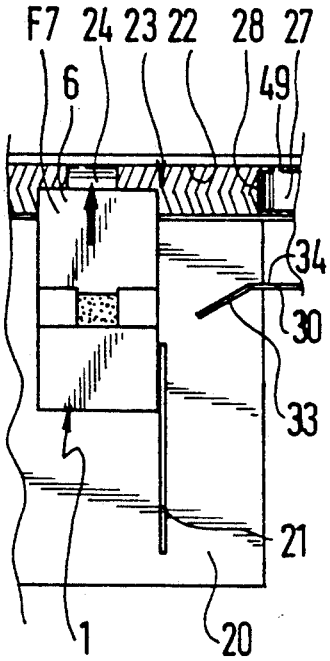
Figure 13:
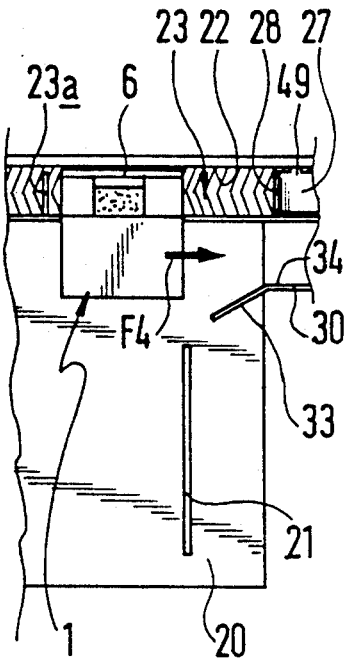
Figure 14:
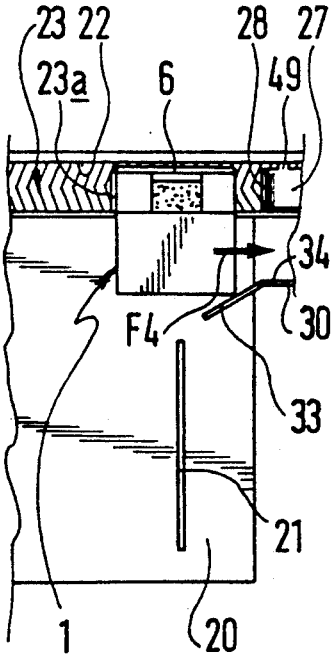
Figure 15:
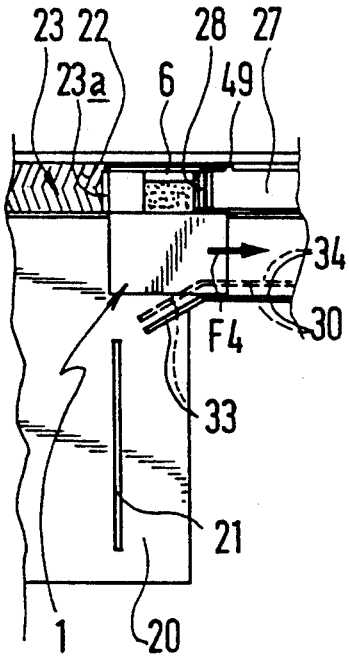

With these arrangements, as soon as the base 2 of the container plate 1 reaches the contact 43, the contact yields upon meeting the spring 44 (FIG. 11) and starts up the motor 45. This causes the driving of the chain 23, and a tappet 23*a* reaches the upstream edge of the container plate 1, such that the set is driven in the direction of the arrows F4.

Simultaneously, or with a slight delay, this set reaches the tip 28 of the vertical pressure element 27 and the oblique segment 33 of the horizontal pressure element 30.

These two elements 27 and 30 move away from their original position, in which they were kept stable under the influence of gravity and of the springs 31-32, respectively. As they urge respectively toward the working surface 20 and the reference plane 22, they keep the container-article set 1 against these planes, the surface of which is smooth and even slippery. The tappet 23*a* of the chain 23 then drives the container-article set 1, which slides between four rectlinear parts, which are parallel two by two, and which together comprise a kind of guide tunnel, made up of two fixed parts (20 and 22) and two adjustable parts (29 and 34).

The vertical pressure element 27 is spaced a slight distance from the profile section 22 to allow the closure panel 6 to pass freely between them (FIG. 8).

Furthermore, the element 27 has a blade 49 at the level of its active face 29 and placed on the side closest to the profile section 22, such that it extends within the space that separates the side of the element 27 and the profile section 22. The blade 49 must not touch the profile section 22, because the blade is intended to merely score the inner or facing surface of the material comprising the closure panel 6 in order to create a weakening line that will bring about clean folding of this panel 6 at the precise level, regardless of the height of the container-article set 1.

In effect, the usable face 29 of the element 27 is compulsorily applied to the uppermost portion of the container-article set 1 or, in other words, onto the outer face of the flap 5, which is located at a level that varies with the thickness of the articles packed. Consequently, regardless of this thickness, the usable face 29 is located on the flap 5, and the blade 49 is at the same level.

Beyond the region where the closure panel 6 is scored by the blade 49, it can be, and must be folded down onto the flap 5.

While the blade 49 is scoring the closure panel 6, an adhesive of any known type is placed on the inside face of the panel, and this operation will be described in further detail below.

Once the placement of the folding line has been determined with exactitude and precision, the folding down of the panel 6 becomes an easy operation, known per se. To accomplish it, devices of any known type are provided, such as an inclined ramp, a presser, rollers, and so forth.

Figure 9:
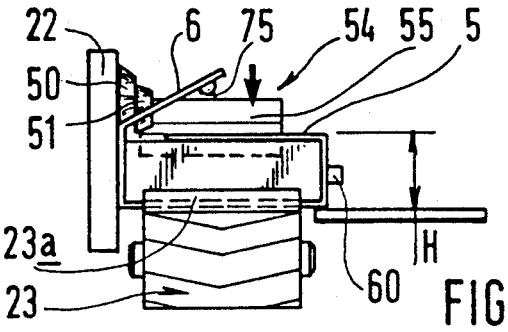
Figure 10:
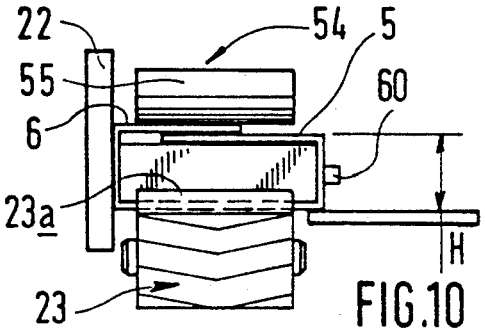
Figure 16:
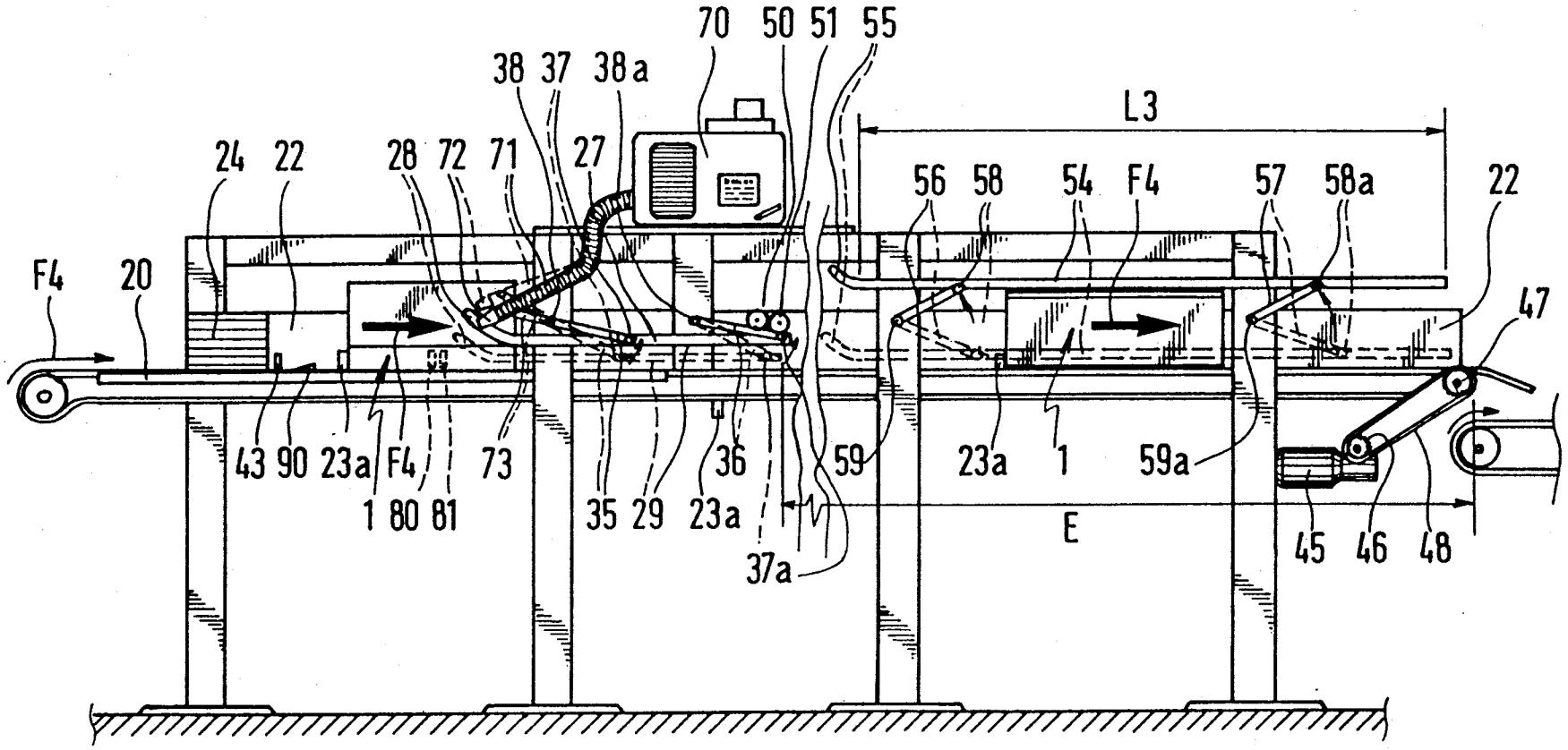
FIG. 16 is a schematic elevation view of a machine according to the invention.

Here, the case shown in FIGS. 9 and 16 is one in which two rollers 50 and 51 are used, which are staggered both from top to bottom and in the direction of an approach toward the center of the container plate. The profile of these rollers is adapted to the slope that the closure panel 6 must assume under the influence of the lowering action of these rollers.

The panel 6 is vertical once the container-article set 1 has been pushed against the reference plane 22. It must be moved progressively horizontally, and a deflector (not shown) may initially be provided, which begins the inclination of the panel 6 in order to present it to the first roller 50, which is the highest and closest to the reference plane 22, or in other words the one farthest from the center of the container plate.

The roller 50, in turn, lowers the panel 6 a little bit and presents it to the second roller 51, which is lower and farther from the reference plane 22 or, in other words, closer to the center of the container plate.

Folding down of the panel 6 is accomplished by a vertical pressure element 54 similar to the element 27, such that the container is completed and is now in the situation shown in FIG. 5, since all its parts are in place and the closure panel 6 is glued to the flap 5.

It can be seen that, the invention provides, a perfectly constituted and closed packet or parcel, regardless of the thickness of the articles A to be packed, and regardless of the dimensions of the container plates 1, within certain size limits for which the machine has naturally been designed and dimensioned.

In an important embodiment of the invention, work is done in three sequences entirely independent of one another and capable of being performed simultaneously, such that it becomes possible to handle container-article sets 1 of quite different dimensions all on the same machine, one after another, and in any order whatever.

Figure 17:
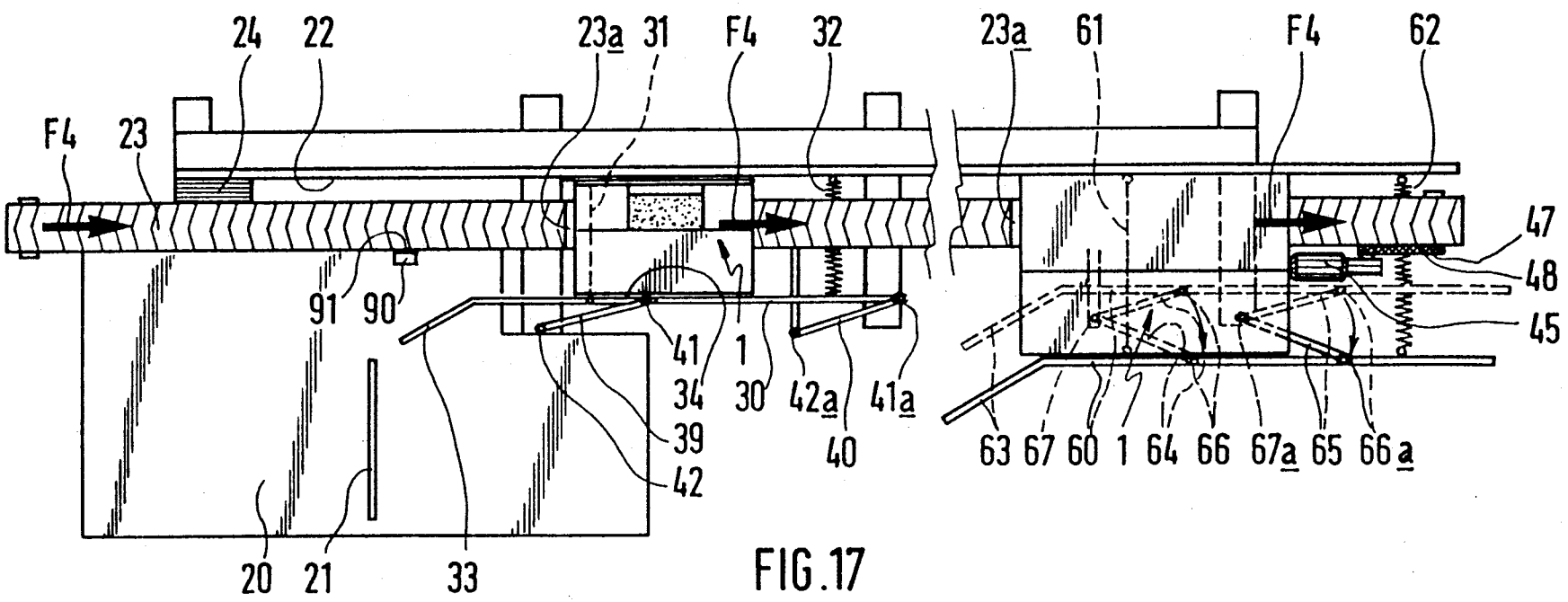
FIGS. 17 is a schematic plan view of a machine according to the invention.

Turning now to FIGS. 16 and 17, it can be seen that the machine includes two vertical pressure elements and two horizontal pressure elements disposed serially in the upstream-to-downstream direction.

The first pair, that is, the vertical pressure element 27 and horizontal pressure element 30, should guide a single container-article set 1, since this set is held by these elements and until the closure panel 6 has undergone the scoring by the blade 49 and receives the adhesive. Next, as noted above, the panel 6 is folded down, and the second pair of elements comes into play, in order to guide the container-article set 1 to exert a pressure for the time required for setting of the adhesive.

The second pair includes a vertical pressure element 54 similar to the element 27, so there is no need to describe it again. However, it should be noted that the element 54 has a usable length L3, which is calculated as a function of the speed of displacement of the chain 23 and as a function of the nature of the adhesive deposited on the panel 6, so that the pressure vertically exerted by the element 54 will be exerted for a long enough time to assure correct gluing or, in other words, to avoid any risk of accidental reopening upon leaving the machine.

It is noted that the length L3 is indeed the usable length, not including the tip 55 similar to the tip 28 of the element 27, because the tip 55 does not actually exert pressure but assures the ascent of the element 54 when a container-article set 1 arrives and contributes to pressing the panel 6 onto the flap 5. The actual pressure affecting the setting of the adhesive does not begin until beyond the tip, and it is from that region that the usable length L3 should be measured.

In FIG. 16, dotted lines show the element 54 in the lowermost position, which it occupies by its own weight. It is connected to the frame of the machine by connecting rods 56 and 57 articulated in an inclined parallelogram, on the one hand to the element 54 via pivots 58 and **58*a* and on the other hand to the machine frame via pivots 59 and 59*a*. Solid lines show a raised position, corresponding to the handling of a very high container-article set 1**.

The connecting rods 56 and 57 are inclined such that at the moment of first contact with a container-article set 1, the element 54 has a tendency to be displaced in the same direction, while rising, in order to facilitate this rising and the advancement of the container-article set 1.

While one container-article set 1 is under the element 54, displaced by a tappet **23*a* of the chain 23, another set 1 is under the element 27. FIG. 16 clearly shows the difference in height between these two sets 1, which is due to the great difference in thickness of the articles that they contain. It should also be emphasized that this difference is exaggerated in the drawing, with respect to the dimensions of the tips 28 and 55**. This is intentional for the sake of better comprehension of the invention, and should not be considered as an error in description.

It will be understood that the distance between two successive sets 1 depends on the spacing between two tappets **23*a* of the chain 23, and that that spacing, in turn, is a function of the relative dimensions of the elements 27 and 54. The rule to be obeyed is that the spacing E must be such that the set 1 that is the farthest advanced will have arrived at its point of removal (the right-hand end of the machine in FIG. 16) no later than the instant when the set 1 following it arrives in front of the element 54. This means that the spacing E must take into account the longest possible length for a set 1**. In fact, the spacing E must be at least equal to the sum of L3 and this longest possible length.

The process can thus be performed in three sequences: one of gluing under the element 54, one of placing a deposit of adhesive under the element 27, and a third manual sequence of presenting and applying the panel 6 to the reference plane.

It is then sufficient to provide a total of three tappets **23*a*, because then the third one arrives to drive the final set 1 in a perfectly automatic manner coordinated with the position of the other two. Thus, a quasi-continuous function of the machine is assured while allowing differences of major dimension among the successive sets 1**.

The principle of "he who can do more can also do less" makes it possible to apply the invention to series of identical sets 1, which demonstrates the great flexibility in usage of the machine.

In FIG. 17, a plan view of the machine is shown in the same situation as FIG. 16. Just as FIG. 16 includes two elements 27 and 54 for vertical pressure, FIG. 17 includes two elements 30 and 60 for horizontal pressure that are similar to one another.

It can be clearly seen that two sets 1 of different widths can be on the machine together without impeding one another, one facing the element 30 and the other facing the element 60.

Like the element 30, the element 60 is urged in a waiting position by two springs 61 and 62. For the sake of clarity in the drawing, the spring 61 is represented by a single dotted line.

The upstream end of the element 60 also has a rectilinear and angularly displaced oblique entry segment 63 to play the role of a ramp and bring about the spacing apart of the element 60 counter to the springs 61 and 62 when a set 1 arrives.

The element 60 is connected to the frame of the machine by connecting rods 64 and 65 articulated in a paralellogram, on the one hand to the element 60 via pivots 66 and 66*a* and, on the other hand, to the frame of the machine via pivots 67 and 67*a*. In this way and just as with the element 30, its sides remain parallel during its movements away from and toward the reference plane 22.

Two operations are accomplished between the pair of elements 27 to 30 and the pair of elements 54 to 60: folding down of the closure panel 6 and fixation of it to the flap 5 to complete the enclosure of the container "around" the packed article A.

As indicated above, there are several ways to accomplish this fixation: tying it with strapping, staples, gluing and other more sophisticated ways, which need not be described here because they are known in the prior art.

In FIG. 5 a single tape 65 has been shown in dotted lines, placed longitudinally in the middle of the container 1. There could be several of these: two longitudinal ones parallel to one another and one transverse one, for example. The automatic devices capable of putting such tapes in place exist and are not part of the present invention. With a machine according to the invention, such a device would be placed downstream of the pair of elements 27-30, after folding down of the closure panel 6 onto the flap 5 and temporarily holding them in a good position.

In FIG. 5, another solution has also been shown, which comprises placing two staples 66 and 67 on the sides of the container 1, because in this region the inner face of the flap 5 is accessible because of the presence of the sidewalks 7 and 8 on the sides. It is thus possible without particular difficulty to select a stapling device among those in existence and well known to one skilled in the art. Such a device would be placed downstream of the pair of elements 27-30, after folding of the closure panel 6 on the flap 5 and temporarily holding them in a good position.

In the two cases that have just been described, the pair of elements 54 and 60 may prove unnecessary, if the closed container 1 is removed soon enough.

If the closure system is used that comprises gluing the panel 6 to the flap 5, then two problems need to be solved. One is to deposit an adhesive in a correct zone, regardless of the thickness of the article A, and hence regardless of the level at which the flap 5 is located (height H) and regardless of the height of the closure panel 6 above this level. The second problem is to set the adhesive, because this requires a certain minimum period of time, and furthermore, depending on its physical and chemical characteristics, it requires some pressure force and/or a polymerization operation.

Here, the example selected is of an adhesive that is heated and arrives at the correct setting in a relatively brief period of time with some pressure force.

Since the purpose is to glue the flap 5 and closure panel 6 together, it does not matter whether the adhesive is deposited on the outer face of the flap 5 (which at the moment of this operation is horizontal) or on the inner face of the panel 6 (which is vertical at the time of that operation).

The ensuing description applied to the case where the choice has been made to deposit the adhesive to the inner face of the panel 6.

In either case, the adhesive must be located correctly, regardless of the level of the flap 5 and regardless of the format of the container plate 1, depending on the dimensions of the article A to be packed.

Turning to FIG. 18, a flat container plate 1 is seen from the side, which corresponds to the situation of FIG. 1; the factors illustrated by this drawing figure and the next two figures are independent of the actual dimensions of this container plate 1.

In FIG. 19, the container plate 1 is used for an article A the thickness of which is such that the outer face of the flap 5 is located at a height H1 with respect to the working surface 20.

In FIG. 20, the container plate 1 is used for an article A the thickness of which is such that the outer face of the flap 5 is located at a height H2 with respect to the working surface 20.

As has been seen above, the usable face 29 of the element 27 is applied against this face and will then also be located at the height H1 or at the height H2.

It is when the container plate 1 is under the element 27 (or in any case before the panel 6 has been folded down) that the adhesive must be deposited on the inner face of the panel 6, which at that time is vertical. If the adhesive depositing device has been displaced in height as a direct function of variations in the height H, then it must ascend when the height H increases and descend when the height H decreases.

A vertical arrow F8 schematically represents the element 27 applied to the flap 5 and it is assumed to indicate the level at which the adhesive is deposited; this level is symbolized by a horizontal arrow F9.

Under the conditions of FIG. 19, this system is correct, since the height of the flap 5 provides that the arrow F9 is at a level such that the adhesive depositing device will be located facing the panel 6, near its free edge.

Under the conditions of FIG. 20, on the contrary, this system is not usable, since the height H2 at which the flap 5 is located positions the arrow F9 much too high, above the free edge of the panel 6, which means that the adhesive would be shot into the open air instead of being deposited onto the panel 6. In order for the device to be coordinated with the height H2, the level of the adhesive depositing device must be lower, as the arrow F10 indicates.

It is clear from these explanations that the adhesive depositing device must be lowered when the height H increases and must be raised when the height H decreases, relative to the motions of the element 27. The result of these relative motions may also be a true variation with respect to the working plane, or may merely be relative, which can mean that the nozzle 72 has a motion with respect to the element 27 but remains at the same level with respect to the working plane 20.

These explanations make it possible to understand the ensuing description of the adhesive depositing device.

Turning to FIG. 16, it is seen that the machine according to the invention includes an adhesive distributing device 70 including a reservoir and provided with all the necessary typical accessories, including an electric supply making it possible to heat the adhesive material and enabling the functioning of the desired components such as a pump, solenoids, etc.

The reservoir receives a flexible conduit 71 that ends at a nozzle 72 located facing the path provided for the closure panels 6 of the containers. In order to adhere to the principle of height adjustment explained above, the nozzle 72 (or a rigid collar holding the flexible conduit 71) is affixed to an extension 73 of the connecting rod 35, disposed beyond the pivot 38 or in other words, upstream.

Thus when the element 27 is raised, the connecting rod 35 rotates about the pivot 37, and the pivot 37 is raised while the extension 73 and the nozzle 72 that carries it are lowered in proportion to the difference existing between the length of the lever arm, on the one hand, measured between the pivot 38 and the nozzle 72, and the length of the connecting rod per se 24, on the other.

With these arrangements, and subject to some initial adjustments as a function of the container plates 1 intended to pass over the machine, it is assured that the nozzle will properly distribute the adhesive onto the closure panels 6 regardless of the height H.

Turning now to FIGS. 21–26, it can be seen how the startup and stopping of the adhesive distributing device is controlled as a function of the actual width of each closure panel 6 involved.

It should be remembered that changing the size of the containers 1 involves not only their height as a function of the thickness of the articles A to be packed (which is managed by the mobility of the elements 27 and 54) and their width (managed by the mobility of the elements 54 and 60) but also their length, which is the direction of displacement with respect to the planes 20 and 22 and consequently the extent to which the adhesive must be deposited.

The means by which the proper distribution and nondistribution of adhesive is brought about will not be described, because complete devices that perform all the functions necessary are available on the market. For comprehension of the ensuing explanation it can be assumed, for example, that a solenoid (not shown) is interposed between the adhesive reservoir and the nozzle 72, such that one contact is sufficient to control the opening and closing of this solenoid.

If the closure panels 6 of the container plates 1 all had the same dimensions, then a single contact could be sufficient, possibly a time delay contact, to control the solenoid and thus bring about the arrival and interruption of adhesive. However, precisely, the problem presented here is insoluble with the known means.

According to the invention, the longitudinal distribution of adhesive is made possible regardless of the length of the panels 6 in the following manner:

The machine includes two contacts 80 and 81 controlling the solenoid. They are located vertically of the reference plane 22 (or optionally in immediate proximity to it) and are offset in the direction of displacement of the container-article sets on the machine by the chain 23.

They are electrically connected in such a manner that the following operations are performed:

In FIG. 21, since the container article set 1 being displaced (closure panel 6 or any other "downstream" edge) is no longer located vertically of one of the contacts 80 or 81, the distribution of adhesive does not occur.

In FIG. 22, the downstream edge **6*a* of the set being displaced reaches the contact 80** only, and the distribution of adhesive still does not take place.

In FIG. 23, the downstream edge **6*a* of the set being displaced reaches the second contact 81; the panel 6 is vertically of the two contacts 80 and 81 simultaneously, which brings about the effective distribution of adhesive via the nozzle 72, which ejects the adhesive 75 that is deposited on the inner face of the panel 6**.

In FIG. 24, since the set continues to be driven by the chain 23 and the container plate has a certain length, the panel 6 remains vertical of the two contacts 80 and 81; the adhesive is still distibuted by the nozzle 72 and forms the beginning of a continuous strip.

In FIG. 25, it can be seen that the strip of adhesive 75 has continued to be formed over the entire length of the panel 6 and comes to its end, because the set 1 has been driven by the chain 23 and its upstream end **6*b* has moved past the contact 80, which brings about the stoppage of the adhesive device, and the strip 75 has thus stopped before the upstream edge 6*b* is located facing the nozzle 72**.

In FIG. 26, the upstream edge **6*b* has also moved past the second contact 81; the distribution of adhesive has stopped, and the machine is again in the situation shown in FIG. 21**, ready for the deposition of the adhesive onto a new container, depending on the length of the container, whatever this length may be.

Since the machine is designed for performing the method according to the invention, which solves the problem of how to mechanize packaging in containers of different sizes, it should accept container plates so small that their length does not quickly reach the tip 28 of the vertical pressure element 27.

The result for very small container plates is the risk of shifting or even blockage, because the chain 23 driving the container article set along the reference plane 22 causes friction that has a tendency to move the set away, because the elements 27 and 30 retain the container as soon as it reaches them.

The dimensions of the container plates are not randomly uneven. When one dimension (length or width) is small, the other (width or length) is small as well. This means that if a formed container article set has a length too short to rapidly reach the element 27, its width is also small. This is why it is advantageous to provide a stop on the machine that is specifically provided for small set.

In FIGS. 6, 16 and 17, it can be seen that this stop 90 is provided projecting from the working surface 20 near the edge of the chain 23, and that it takes the form of an inclined plane. In this position it is urged, for example by means of a spring, and is movable to below this working surface 20 by simple pressure downward. This enables the unhindered passage of large container-article set 1 above this stop 90, because its inclined plane form compels it to sink to the level of the surface 20 when a set reaches it from upstream to downstream.

Contrarily, if the container article set is small in size, its width is practically no more than that of the chain 23 and is enclosed between the reference plane 22 and the usable face 91 of the stop 90, located vertically facing the plane 22.

When such a set is driven by the chain 23, it is then held against the plane 22 by the usable face 91 of the stop 90, which plays the role of the usable face 34 of the element 30.

As soon as this set is held vertically by the element 27, it is also held horizontally against the reference plane 22 by the element 30, and the stop 90 has finished playing its role.

If the set is larger, it passes above the stop 90 and compels it to move away. It is then held by the elements 27 and 30 as described above.

One important application of the invention is for postal shipments, and this assumes that there is some labeling.

Depending on whether mass shipping or strictly individual shipping is involved, the problem of labeling presents itself in different terms.

For mass shipping, labels can be provided (optionally in an envelope that also contains other documents such as shipping papers, invoices, brochures, work orders, and so forth) that are applied universally to all the container-article sets leaving the machine, since theoretically all the shipments are identical.

If strictly individual shipping is involved, the container-article sets are specific and care must then be taken to distinguish each of them properly. Mechanical and automatic means do exist that enable applying a label (optionally a complete envelope) to a given container plate as opposed to others, either at the beginning of the process, in which case the container plate receives its identification before being handled by the machine, or at the end of the process, in which case the container plate receives its identification after being closed.

One economical and sure solution comprises providing a window in the base 2 and placing a document against this base 2, so that the address of the addressee can be seen through this window.

It should be noticed that the base 2 remains invariable in dimension and position during the entire handling process, unlike the flap 5 and especially the panel 6, such that the positioning of the document selected at the beginning is maintained until the end.

When container plates the base of each of which is close to one end as used, the manual operations at the beginning of the cycle are slightly different: The tabs 3 and 4, in this hypothesis, would be placed vertically of the flap 5 that becomes the "base". After folding up the tabs 3 and 4 and folding them onto the article A, the flap that now is constituted by the central portion of the container plate (the base having become a "flap") must be placed on these tabs 3 and 4, which is done by folding down onto the flap the set of "base" 5, tabs 3 and 4, and article A. This procedure entails manually inverting, in a "rolling" manner, the base 5 with the article A retained thereon by the tabs 3 and 4, whereby the exposed surface of the article, i.e., that engaged by the tabs, is placed in facing relation to the flap portion with the tabs being placed in face-to-face surface engagement therewith.

The other operations are unchanged: folding up of the panel 6, scoring, gluing, etc. However, it should be noted that the closure panel here is applied to the outer face of the central portion, rather than to the outer face of an end flap.

The completed package or parcel has the same appearance as that of FIG. 5, except for some insignificant details.

Now turning to FIGS. 27–30, a variant embodiment of the invention can be seen.

The method always comprises folding the closure panel 6 up and then folding it onto the top of the set 1, but instead of initially folding up the panel 6 and then displacing the container-article set, this folding up is performed during the displacement.

Furthermore, the machine no longer has a ramp 24 disposed frontally facing the working plane 20 and hence on this side of the reference plane 22. The reference plane is penetrated by a slot 100, through which the closure panel 6 can be passed when it is parallel to the working plane 20, with the folding up of this panel 6 being performed beyond the reference plane 22.

Facing the working surface 20, the slot 100 has a height sufficiently great to allow free passage of the panel 6 without the operator having to attend to it precisely. However, this height must also be slight enough that a relatively thin set 1 can abut against the face of the reference plane adjacent to the working surface 20.

The slot 100 is lengthened by a slot 101 that is not as high and extends under the reference plane 22. The junction of the slots 100 and 101 determines an inclined stop 102, which allows the passage of the panels 6 in the slot 101 when they have the maximum authorized thickness; but it stops every set 1 that is too thick, which would be the case for example if a panel is engaged improperly and/or displaced improperly and becomes skewed.

This arrangement is very advantageous, because it stops the sets 1 before they can reach the active devices of the machine that will be described hereinafter.

In a simple version of the machine, it is assumed that the operator will immediately observe the anomoly and can take care of it, for example by stopping the chain 23 in order to remove the jammed set 1.

In a more sophisticated version of the machine, use is made of the fact that stoppage by the stop 102 creates a resistance to the forward motion of the chain 23; the value of this resistance is calculated to control either an automatic stoppage of the chain 23 or an alarm that draws the operator's attention to it, or any other action.

Figure 28:
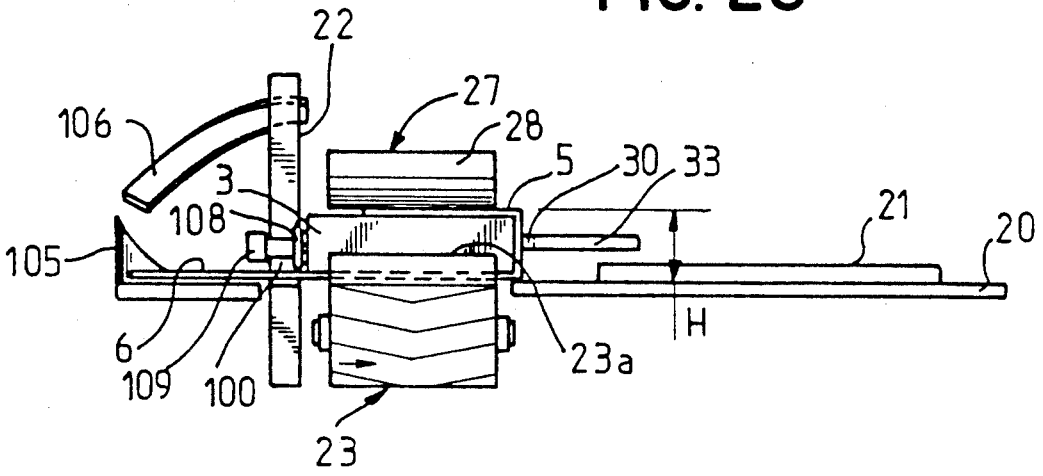
FIGS. 28-30 are schematic elevation views showing important phases in the operations according to the packing method according to the invention, when it is used by a machine of the type shown in FIG. 27 and applied to a container plate of the type shown in FIGS. 1 and 2.
Figure 29:
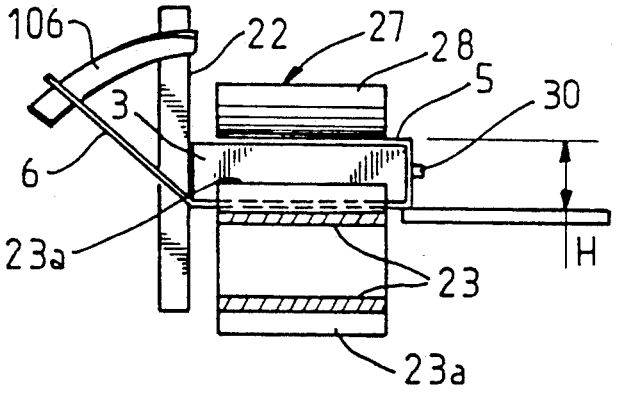

With these arrangements, the operator acts as described above, including pushing the set 1 in the direction of the arrow F7, but the closure panel 6, instead of meeting the ascending ramp 24 and being folded up the face of the plane 22 adjacent to the surface 20 passes into the slot 100 and its leading end extends beyond the reference plane 22. The set 1 abuts against the reference plane 22 by the edges of the tabs 3 and 4 (FIG. 28).

When a tappet **23*a* meets the set 1, the chain 23 drives it as has been described, with the closure panel 6 always being parallel to the working surface 20**.

Beyond the reference plane 22 is a helical ramp 105, which extends parallel to the plane 22 in order to bring about the folding up of the closure panel 6 during the displacement of the set 1.

The action of the ramp 105 may be supplemented with a second ramp or guide 106, located higher up, and which completes the folding up of this panel 6.

With the set 1 now being pressed against the reference plane 22 by the pressure element 30, the closure panel 6 must be creased suitably perpendicular to the edges of the tabs 3 and 4. However, it is more certain to score the material making up the container 1, by creating a clean, strictly rectilinear folding line.

Figure 33:
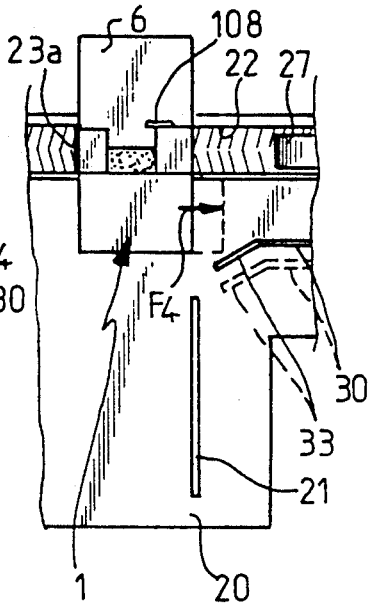

To do so, a small wheel 108 is provided, driven by a motor 109 (or by a kinematic connection with a movable portion of the machine such as a gear for driving the chain 23), this small wheel 108 being located downstream of the stop 102 and upstream of the ramp 105 (see FIGS. 28 and 33).

Thus when the closure panel 6 begins to be raised by the ascending helical ramp 105, the folding line has already been created and guarantees correct geometry.

When the closure panel 6 is in the vertical position, it must necessarily be placed against the "forward" face of the reference plane 22, or in other words on the facing side rather than the other side of this plane 22.

To assure the passage of the closure panel 6, an opening 110 (FIG. 34) is made in the reference plane 22, the length of the opening depending on the slope of the ramps 105 and 106; the less time it takes to fold up the closure panel 6, the shorter the opening 110 can be, but the quality of the material used to make the container 1 must be taken into consideration and may prohibit excessively rough actions.

Figure 34:
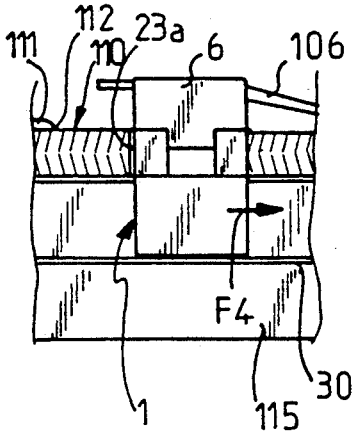

To facilitate the passage of the panel 6 through the opening 110, the reference plane 22 has a beveled wall 111 that terminates in a slender vertical edge 112 (FIGS. 27 and 34).

Figure 30:
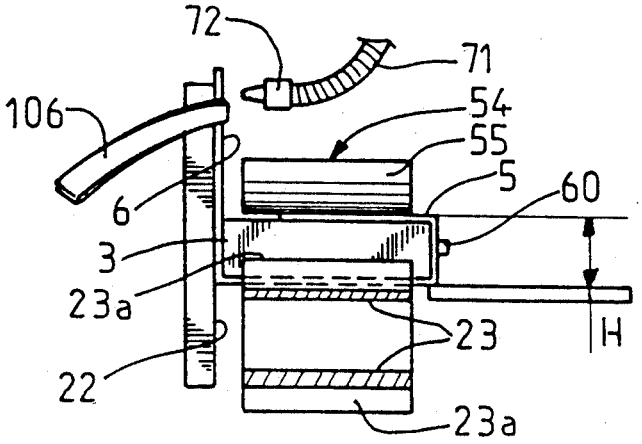
Figure 31:
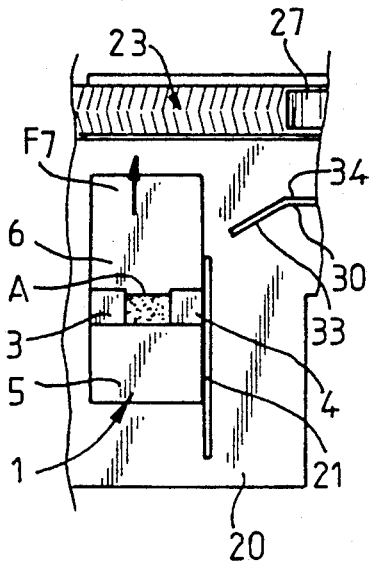
FIGS. 31-35 are schematic plan views showing important phases in the operations according to the packing method according to the invention, when it is used by a machine of the type shown in FIG. 27 and applied to a container plate of the type shown in FIGS. 1 and 2.
Figure 32:
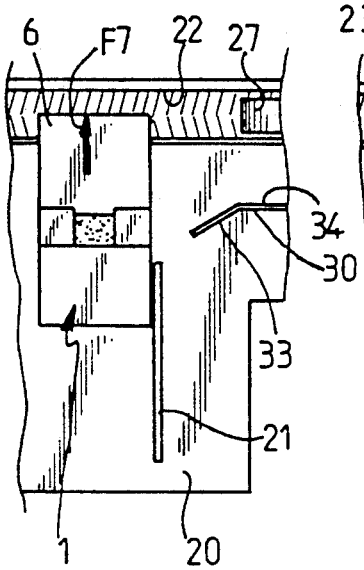
Figure 35:
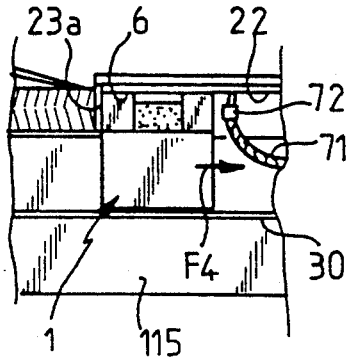

The nozzle 72 is located facing the reference plane 22, downstream of the opening 110 in terms of the direction of displacement of the set 1, in order that the closure panel 6 will be stabilized, or in other words pressed with its entire outer surface against this reference plane 22 (FIGS. 30 and 35).

All the operations that follow are identical to those that have been described by the preceding embodiment, and consequently will not be described again here.

With the embodiment described in connection with FIGS. 11–17, it is seen that the sets 1 rest only on the chain 23 when they have left the working surface 20.

If the chain 23 is relatively narrow, this arrangement may be sufficient, because of the pressure elements 30 and 60, which contribute not only to the longitudinal guidance of the sets 1 but also to their crosswise stability.

On the other hand, when the sets 1 are very large and very heavy, accidental movements may occur that are capable of creating irregularities in gluing and/or in closing.

To avoid these disadvantages, lateral supports 115 are provided, located at the same level as the working surface 20, and above which supports the pressure elements 30 and 60 can be displaced freely (FIG. 27, 34 and 35).

The machine can then be used for sets 1 of very different dimensions and capable of attaining great widths.

Turning now to FIGS. 36 and 37, a variant of the invention is illustrated with which it is possible to attain a machine capable of being used either for packing articles and sets of articles of different sizes or for packing a large number of articles or sets of articles that are all identical.

In other words, machines of one and the same type can be used for very different needs.

To this end, the pressure elements 30 and 60 that are urged toward the reference plane 22 are associated with blocking means that keep these elements 30 and 60 at a fixed distance from the reference plane 22. Thus for large quantities of identical sets 1, the mechanical fatigue caused by the lateral displacements of the elements 30 and 60, by the work of the return springs and by the friction of the sets 1 against the segments 33 and 63 is avoided.

Guidance and retention of the sets 1 are assured without needless wear and without superfluous expenditure of energy.

Here, this variant has been illustrated by providing two series of smooth holes, 120 and 121, respectively, for each pressure element 30 and 60, the holes being made in the support 115 and being distributed in two circular arcs centered on the pivots of the connecting rods of the elements 30 and 60. To simplify the description, reference will be made merely to the element 60, but all the elements described for the element 60 are the same, mutatis mutandis, for the element 30.

In FIG. 36, it is seen that the circular arcs of the holes 120 and 121 are centered on the pivots 67 and **67*a* so that they are each located at the geometric site of a given point of the element 60**.

At each of these points, a threaded hole 122 is made that is capable of receiving, by screwing, the threaded shaft 123 of a detachable bolt 124.

To block the element 60 at a given distance from the reference plane 22, action is exerted on this element 60 to space it apart from its natural position, which is the closest possible to the reference plane 22, by the action of the springs 61 and 62. When it is located at the desired distance, its threaded holes 122 are each perpendicular to a smooth hole 120 and 121. The threaded shaft 123 of two bolts 124, from below the support 115, are then made to engage the two smooth holes 120 and 121, and the threaded shaft 123 is screwed into the corresponding threaded hole 122.

The element 60 is thus solidly fixed to the fixed support 115.

A hole 120–121 is necessarily located perpendicular to a hole 122 of the element, because the holes 120 and 121 have been made as a function of the most up-to-date sizes for the sets 1.

It follows moreover that the holes 120 and 121 are not necessarily equidistant, since their spacing depends on standardized or conventional dimensions of the sets 1.

If the elements 30 and 60 are too thin and/or too fragile to be pierced directly by threaded holes 122, then studs of larger dimensions may be provided which are solidly joined to these elements 30 and 60, taking care that they do not impede the sliding of the sets 1.

We claim:

1. A method for packaging articles having opposed, parallel surfaces in containers formed from plates of pliable material containing a base portion, a flap portion and a closure panel in integral, coplanar relation on apparatus having a working surface, a conveyor movable with respect to said working surface, and a guiding obstruction substantially coextensive with, and extending vertically with respect to, said conveyor, comprising the steps of:

a) forming a set on said working surface by placing an article to be packaged on the facing surface of said base portion of a plate and folding said flap portion across the exposed surface of said article to form a receptacle portion;

b) moving said set onto said conveyor by placing said receptacle portion of said set in engagement with one side of said guiding obstruction with the closure panel extended beyond the other side of said guiding obstruction;

c) moving said set by said conveyor along said guiding obstruction while folding mechanically said closure panel first from the plane of said base portion and thereafter across the opposed surface of said plate;

d) applying adhesive to either one of said closure panel and said opposed plate surface while conveying said set along said obstruction; and e) pressing said closure panel against said opposed surface to effect an adhesive bond therebetween.

2. The method of claim 1 including the steps of applying pressure against said set to hold it in engagement with said obstruction and to hold said article between said base portion and said flap portion while moving said set by said conveyor.

3. The method of claim 2 including the step of moving said set sequentially against scoring tools prior to mechanically folding said closure panel first from said plane of said base portion and thence across said opposed surface of said plate.

4. The method of claim 3 including the step of sensing the vertical dimension of said set and varying the position of a scoring tool in response thereto to form a fold line for folding said closure panel across said opposed surface of said plate.

5. The method of claim 4 in which a vertically movable pressure element applies pressure between said base portion and said flap portion and said scoring tool is carried by said pressure element.

6. The method of claim 1 including the step of maintaining the location of application of adhesive substantially uniform with respect to the leading end of said closure panel.

7. The method of claim 6 in which the location of application of adhesive is maintained by varying the position of discharge of adhesive in response to the vertical dimension of said set.

8. The method of claim 7 including the step of applying said adhesive to said closure panel after said closure panel is folded from said plane of said base portion and prior to folding it across said opposed plate surface.

9. The method of claim 8 in which a movable pressure element applies pressure between said base portion and said flap portion to hold said article therebetween and the position of discharge of adhesive is varied in response to movement of said pressure element.

10. The method of claim 9 in which said movable pressure element carries an adhesive discharge nozzle and including the step of moving said adhesive discharge nozzle proportionately with respect to movement of said pressure element.

11. The method of claim 10 in which the direction of movement of said adhesive discharge nozzle is inverse to the direction of movement of said pressure element.

12. The method of claim 1 including the step of forming said set on said work surface by folding said plate along a transverse line between said base portion and said flap portion by manually inverting said article to place it between said base portion and said flap portion while holding it on said base portion.

13. The method of claim 12 in which said article is held against said base portion by initially manually folding tabs formed integral with edges of said base portion transversely across the exposed surface of said article.

14. The method for sequentially packaging diversely sized articles having opposed parallel surfaces in containers to diverse dimensions to receive such articles from plates of pliable material containing a base portion, a flap portion and a closure panel in integral, coplanar relation on apparatus having a working surface, a conveyor movable with respect to said working surface, and a guiding obstruction substantially coextensive with, and extending vertically with respect to, said conveyor, comprising the steps of:

a) sequentially forming sets on said working surface by placing selected articles to be packaged on the facing surfaces of the base portions of selected plates and folding said flap portions across the exposed surfaces of said selected articles to form a receptacle portion in each set;

b) moving said sets in sequence onto said conveyor by placing the receptacle portion in each set in engagement with one side of said guiding obstruction with the closure panels of said sets beyond the other side of said guiding obstruction;

c) moving said sets in sequence by said conveyor along said guiding obstruction while mechanically folding each said closure panel, in turn, first from the plane of said base portion and, thereafter, across the opposed surface of said plate;

d) applying adhesive to either one of said closure panel or said opposed plate surface of each said set as the sets are moved along said obstruction; and e) sequentially pressing each said closure panel against said opposed plate surface of the associated set to effect an adhesive bond therebetween.

15. The method of claim 14 including the steps with respect to each said set of applying laterally directed pressure thereagainst to hold it in engagement with said obstruction and downwardly directed pressure against said opposed plate surface to maintain said article against said base portion while moving said sets along said conveyor.

16. The method of claim 15 including the step in conveying said sets along said obstruction, of moving each set sequentially against scoring tools prior to mechanically folding the closure panels in each, first from the plane of the associated base portion and thence across said opposed plate surface.

17. The method of claim 16 including the step of sequentially sensing the vertical dimension of each said set and in response thereto varying the position of one of said scoring tools with respect to the closure panel of the sensed set to form a fold line for folding said closure panel across said opposed surface of said plate.

18. The method of claim 17 in which a vertically movable pressure element applies pressure sequentially between the base portion and the flap portion of each said set, and said one scoring tool is carried by said pressure element.

19. The method of claim 14 including the step of selectively varying the position of discharge of adhesive with respect to each set to maintain the application of adhesive at a substantially uniform location with respect to the leading end of said closure panel of each set.

20. The method of claim 19 in which adhesive is applied to the closure panel of each said set and said adhesive application is maintained uniformly disposed with respect to the leading end of said closure panel by varying the position of discharge of adhesive with respect to each said set in response to the vertical dimension of each set.

21. The method of claim 20 including the step of applying said adhesive to said closure panels after each is folded from the plane of the associated base portion and prior to folding each across the opposed plate surface.

22. The method of claim 21 in which a vertically movable pressure element operates to apply pressure between the base portion and the flap portion of each set in sequence, and the position of discharge of adhesive with respect to the closure panel of each respective set is varied in accordance with the movement of said pressure element.

23. The method of claim 22 in which said movable pressure element carries an adhesive discharge nozzle and including the step of moving said adhesive discharge nozzle proportionately with respect to movement of said pressure element with respect to each said set.

24. The method of claim 23 in which the direction of movement of said adhesive discharge nozzle with respect to the closure panel of each said set is inverse to the direction of movement of said pressure element with respect thereto.

25. A method for sequentially packaging diversely sized articles having opposed parallel surfaces in containers formable to diverse dimensions to receive such articles from plates of pliable material containing a base portion having transversely disposed retention tabs, a flap portion and a closure panel in integral coplanar relation on apparatus having a working surface, and a guiding obstruction substantially coextensive with, and extending vertically with respect to said conveyor, comprising the steps of:

a) placing container plates sequentially on said working surface;

b) selectively placing articles to be packaged on the upwardly facing surface of the base portion of said container plates;

c) folding said tabs transversely across the articles placed on the base portion of the respective plates;

d) folding each said plate along a transverse line between said base portion and said flap portion by manually inverting said article to place it between the base portion and the flap portion of each respective plate to form receptacle portions in the separate sets;

e) moving said sets in sequence onto said conveyor by placing the receptacle portion in each engagement with one side of said guiding obstruction with the closure panels of the respective sets extending beyond the other side of said guiding obstruction;

f) moving said sets in sequence by said conveyor along said guiding obstruction while mechanically folding each said closure panel, in turn, first from the plane of said base portion and, thereafter, the opposed surface of said plate;

g) applying adhesive to either one of said closure panel or said opposed plate surface of each said set as the sets are moved along said obstruction;

h) sequentially pressing each said closure panel against said opposed plate surface of the associated set to effect an adhesive bond therebetween; and i) removing said sets from said conveyor.

26. The method of claim 25 including the steps with respect to each said set of applying laterally directed pressure thereagainst to hold it in engagement with said obstruction and downwardly directed pressure against said opposed plate surface to maintain said article against said base portion while moving said sets along said conveyor.

27. The method of claim 26 including the step in conveying said sets along said obstruction, of moving each said set sequentially against scoring tools prior to mechanically folding the closure panels in each, first from the plane of associated base portion and thence across said opposed plate surface.

28. The method of claim 27 including the step of sequentially sensing the vertical dimension of each said set and in response thereto varying the position of one of said scoring tools with respect to the closure panel of the sensed set to form a fold line for folding said closure panel across said opposed surface of said plate.

29. The method of claim 28 in which a vertically movable pressure element applies pressure sequentially between the base portion and the flap portion of each said set and said one scoring tool is carried by said pressure element.

30. The method of claim 25 including the step of selectively varying the position of discharge of adhesive with respect to each set to maintain the application of adhesive at a substantially uniform location with respect to the leading end of said closure panel of said set.

31. The method of claim 30 in which adhesive is applied to the closure panel of each said set and said adhesive application is maintained uniformly disposed with respect to the leading end of said closure panel by varying the position of discharge of adhesive with respect to each said set in response to the vertical dimension of each set.

32. The method of claim 31 including the step of applying said adhesive to said closure panels after each is folded from the plane of the associated portion and prior to folding each across the opposed plate surface.

33. The method of claim 32 in which a vertically movable pressure element operates to apply pressure between the base portion and the flap portion of each set in sequence and the position of discharge of adhesive with respect to the closure panel of each respective set is varied in accordance with the movement of said pressure element.

34. The method of claim 33 in which said movable pressure element carries an adhesive discharge nozzle and including the step of moving said adhesive discharge nozzle proportionately with respect to movement of said pressure element sequentially with respect to each said set.

35. The method of claim 34 in which the direction of movement of said adhesive discharge nozzle with respect to the closure panel of each said set is inverse to the direction of movement of said pressure element with respect thereto.

* * * * *

UNITED STATES PATENT AND TRADEMARK OFFICE

CERTIFICATE OF CORRECTION

PATENT NO. : 5,197,260

DATED : March 30, 1993

INVENTOR(S) : Pierre Chevalier and Gilbert E. Veniard

It is certified that error appears in the above-identified patent and that said Letters Patent is hereby corrected as shown below:

On title page,

In item [73] "Assignee":

after "L'Emballage Carton S.A. (Societe Anonyme), Bretigny Sur Orge, France insert: --by assignment solely of a joint interest from said G.E. Veniard.--

Signed and Sealed this

Ninth Day of July, 1996

*Attest:*

Bruce Lehman

BRUCE LEHMAN

*Attesting Officer*

*Commissioner of Patents and Trademarks*